United States Patent [19]

Makabe et al.

[11] Patent Number: 4,572,095

[45] Date of Patent: Feb. 25, 1986

[54] ELECTRONIC SEWING MACHINE

[75] Inventors: Hachiro Makabe, Kanagawa; Takeshi Kongoh, Tokyo, both of Japan

[73] Assignee: Janome Sewing Machine Industry Co., Ltd., Japan

[21] Appl. No.: 595,144

[22] Filed: Mar. 30, 1984

[30] Foreign Application Priority Data

Apr. 1, 1983 [JP] Japan ..... 58-55045

[51] Int. Cl.[4] ..... D05B 3/02

[52] U.S. Cl. ..... 112/456

[58] Field of Search ..... 112/158 E, 121.11, 121.12, 112/456

[56] References Cited

U.S. PATENT DOCUMENTS 4,177,744 12/1979 Wurst et al. ..... 112/158 E
4,391,212 7/1983 Tamiya et al. ..... 112/158 E
4,441,439 4/1984 Hanyu et al. ..... 112/158 E

*Primary Examiner*—Peter Nerbun

*Attorney, Agent, or Firm*—William A. Drucker

[57] ABSTRACT

An electronic sewing machine is provided with an electronic memory and electronic circuit capable of producing auto-data for controlling the needle lateral amplitude and the fabric feed to thereby form respective stitch patterns of an automatically controlled size, and manual signals acting on the auto-data for manually adjusting the needle lateral amplitude and the fabric feed in response to operation of adjusting dials arranged on a front panel of the machine. The manual signals can be produced separately for adjusting the needle lateral amplitude and the fabric feed independently from each other to thereby stitch a deformed configuration of the stitch pattern, but the machine is so designed that the needle lateral amplitude and the fabric feed are simultaneously adjusted by one and the same manual signal in response to operation of one of the adjusting dials for proportionally enlarging or reducing the automatically controlled size of the stitch pattern with its configuration being unchanged.

3 Claims, 5 Drawing Figures

ELECTRONIC SEWING MACHINE

BACKGROUND OF THE INVENTION

This invention relates to a sewing machine in general, and particularly to an electronic sewing machine capable of proportionally enlarging or reducing the size of a stitch pattern selected from a plurality of stitch patterns stored in an electronic memory of the sewing machine.

In a conventional electronic sewing machine there is provided an electronic memory which stores a plurality of data for controlling the needle lateral amplitude and the fabric feed amount in such manner that the respective stitch patterns may be produced in the maximum size. In actual stitching operation, the selected stitch pattern is automatically reduced to be of an optimum size by the reduction rate data memorized in an auto-data memory. However, there may arise some occasions that the sewing machine operator is required to stitch a pattern of a size different from the automatically controlled size. For example, it may be possible that the operator wishes to produce a floral pattern design, one of the stitch patterns stored in the memory, but the automatically controlled size (shown in FIG. 1 as pattern A) is somewhat larger than that (shown in FIG. 1 as pattern B) he desires to stitch. In order to produce such a proportionally enlarged or reduced pattern design, the needle lateral amplitude and the feed amount must be enlarged or reduced with the same and common rate with respect to the automatically controlled size thereof. However, the manual adjusting system for the needle amplitude and for the fabric feeding amount have been separated from each other and therefore must be operated independently. This has made it difficult to obtain a proportionally enlarged or reduced stitch pattern design.

SUMMARY OF THE INVENTION

This invention has been provided to eliminate the defects and disadvantages of the prior art.

It is an object of the invention to provide an electronic sewing machine according to which a proportionally enlarged or reduced size of a selected stitch pattern can be easily produced with a single manual operation.

According to the invention there is provided an electronic sewing machine comprising, in combination, a first electronic memory storing stitch control data for a plurality of stitch patterns which are selectively read out for controlling needle lateral amplitude and fabric feeding amount per stitch of a selected pattern; a second electronic memory storing auto-data which are each specific to each of the patterns stored in the first memory for automatically acting on each data of the selected pattern, thereby determining the optimum size of the pattern; means for detecting if the selected pattern is proportionally variable, which in the affirmative produces an address signal for reading out the initial stitch control data of the selected stitch pattern from the first memory and another address signal for reading out an auto-data specific to the selected stitch pattern from the second memory; means manually operated to produce a first and second signals for modifying the stitch control data for the needle lateral amplitude and fabric feeding amount respectively, said means including first and second switches being selectively operated to make effective the first and second signals for modifying the stitch control data of the selected stitch pattern; means operated in association with a predetermined state of the first and second switches to make effective one of the first and second signals produced by the manually operated means, thereby proportionally varying the size of the selected pattern; calculating means for receiving the stitch control data of the selected pattern from the first memory and said one of the first and second signals from the last mentioned means to calculate out modified stitch control data, so as to proportionally vary the stitches of the selected pattern; and drive means operated in response to the modified stitch control data supplied from the calculating means to control the needle lateral amplitude and the fabric feeding amount.

BRIEF DESCRIPTION OF THE DRAWINGS

The foregoing and further objects and advantages of the invention can be fully understood from the following detailed description when read in conjunction with the accompanying drawings in which.

PREFERRED EMBODIMENT OF THE INVENTION

Now, the invention will be described in conjunction with a preferred embodiment thereof with reference to the accompanying drawings.

Figure 2:
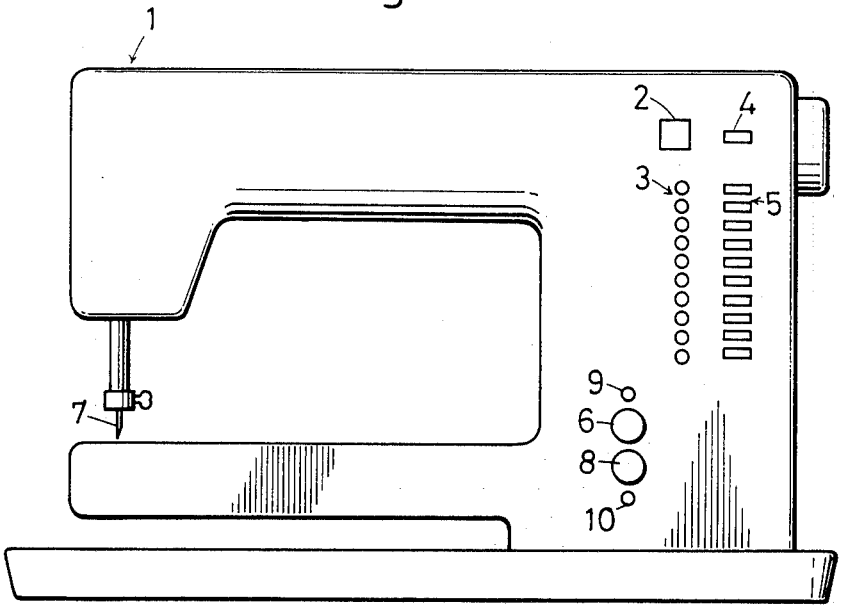
FIG. 2 is a schematic view of a front part of the sewing machine of the invention.

FIG. 2 shows an electronic sewing machine having the invention applied thereto. In a sewing machine housing 1 there is provided an electronic memory element (not shown) storing a plurality of stitch control data for different stitch patterns to be selectively stitched. The stitch patterns are generally selected by selective operation of pattern selecting switches 5 which are arranged on a front panel of the housing 1, and are each in correspondence with light emitting diode. The reference numeral 2 is a number indicating part by way of 7-segment diodes for representing the stitch patterns of less selection frequency by a pattern number, instead of the diodes 3. The reference numeral 4 is a slide switch for changing the pattern selection mode of the sewing machine, namely the switch 3 is operated to change the pattern selecting switches to ten-key switches for selecting the patterns of less selection frequency, the selected one of which being represented at the indicating part 3 by way of the corresponding number.

The data for controlling the lateral amplitude of a needle 7 and the amount of fabric feed are preset in the electronic memory element for respective patterns so as to automatically produce a selected stitch pattern of a predetermined standard size. However, when desired, the needle amplitude and the fabric feed can be adjusted to enlarge or reduce the size of the selected stitch pattern by operating dials 6 and 8. The needle amplitude adjusting dial 6 is pushed to be made effective for adjusting the needle amplitude and is then rotated to proportionally enlarge or reduce the needle lateral amplitude per stitch of the selected pattern. In the same way, the dial 8 is designed to adjust the amount of fabric feed. Thus, the needle amplitude and the feed amount can be manually increased or decreased depending upon the rotating amount of the dials 6 and 8, respectively. The light emitting diodes 9 and 10 are lightened when the dials 6 and 8 are being pushed. The re-pushing operation of the dials 6 and 8 will return the sewing machine to the initial automatic operation.

Figure 3:
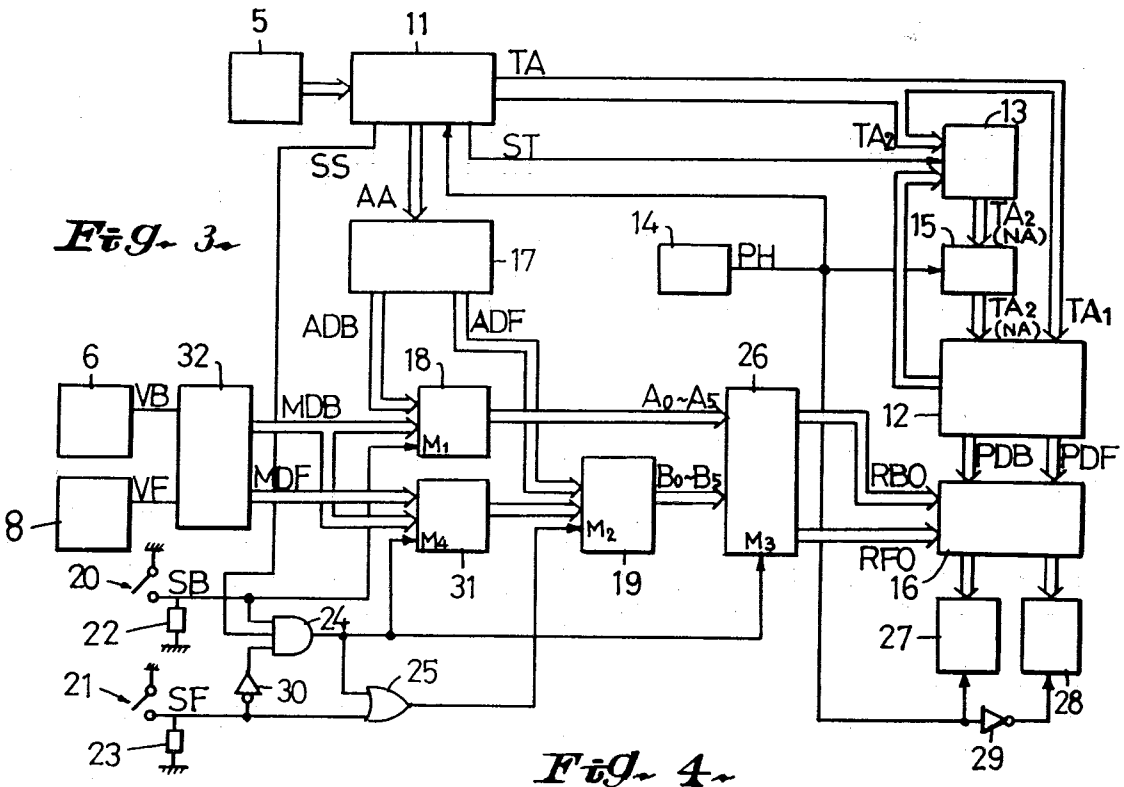
FIG. 3 is a block diagram of a control circuit of the invention.

FIG. 3 is a block diagram of a control circuit of the invention. The selective operation of the pattern selecting switches 5 to select a desired one of the stitch patterns will give a corresponding number signal to a control unit 11 which produces high level signals H respectively at the output TA for addressing a first memory 12 to read out the data for the first stitch of the selected stitch pattern, at the output AA for addressing a second memory 17 to read out the auto-data of the selected stitch pattern, and the first start ouput ST. At the same time, the control unit 11 detects whether the selected stitch pattern is to be enlarged or reduced, and in the affirmative case produces a high level similarity signal at the output SS.

The address signal TA has the first part $TA_1$, applied to the first memory 12 storing stitch control data and the second part $TA_2$ applied to a multiplexer 18. The address signal $TA_2$ is then issued from the multiplexer 18 while the latter receives the high level signal ST from the control unit 11. A latch circuit 15 latches the address signal $TA_2$ each time the latch circuit 15 receives a high level phase signal PH which is issued from an upper shaft phase signal generator 14 each time the needle 7 reaches above the fabric, and then the address signal $TA_2$ is applied to the memory 12. With the address signals $TA_1$, $TA_2$ thus applied the memory 12 produces the amplitude control data PDB, the feed amount control data PDF for the first stitch of the selected pattern, and the next address signal NA for reading out the next stitch control data. The control data PDB and PDF are applied to a calculator 16, and the next address signal NA is applied back to the multiplexer 13.

Next, when the needle 7 descends to penetrate the fabric, the phase signal PH is changed to the low level L and the start signal ST simultaneously becomes the low level L. Then, the multiplexer 13 gives the next address signal NA to the memory 12.

When the phase signal PH is turned again to the high level H, the next address signal NA is latched in the latch circuit 15 whereby the address signal $TA_2$ will read out the next data for controlling the needle amplitude and fabric feed amount for the next stitch of the selected pattern, which are given to the calculator 16.

Meanwhile, the auto-data address signal AA is transmitted to the auto-data memory 17 storing the auto-data ADB and ADF for controlling the needle amplitude and fabric feed amount of the selected pattern, and then the data are read out and applied to multiplexors 18, 19 respectively. The auto-data are used as the coefficients to calculate the stitch control data PDB, PDF of the selected pattern issued from the memory 12.

The control operation of the needle amplitude and fabric feed amount by means of the control units 6 and 8 will be described, on the assumption that the operator select a stitch pattern which may be enlarged or reduced with the original configulation being unchanged.

When the dials 6 and 8 are not being pushed and remain inoperative, the switches 20 and 21 are opened, and an amplitude signal SB and fabric feed signal SF are both at the low level L via resistors 22 and 23. A multiplexor 18 receives at the mode input $M_1$ the low level signal SB to thereby produce the auto-data ADB for needle amplitude. The low level signal SB is also connected to the input of the AND circuit 24. The low level output of the AND circuit 24 and the low level signal SF are connected to the respective inputs of the OR circuit 25, the output of which will thereby become to be at the low level L and connected to the mode input $M_2$ of the multiplexer 19 which produces the auto-data ADF for fabric feed. These auto-data ADB and ADF are then given to a reduction restriction circuit 26. In this case, as the circuit 26 receives at the mode input $M_3$ the low level output of the AND circuit 24 and gives no influence to the input data, these auto-data ADB and ADF are passed through the circuit 26 without being subjected to the reduction restriction execution thereof, and proceeded to the calculator 16 in which the auto-data ADB and ADF are calculated with the predetermined amplitude data PDB and the predetermined fabric feed data PDF for the selected stitch pattern, which have been supplied from the memory 12, to produce the data of an automatically controlled reduction rate, to thereby determine the optimum size of the selected pattern. The automatically reduced data for needle amplitude and fabric feed are then given to needle amplitude control device 27 and fabric feed amount control device 28 respectively. These control devices 27 and 28 are operated respectively in synchronism with the phase signal PH to control the needle amplitude when the phase signal PH is high level H, and to control the feed amount when the phase signal PH is low level L, which is applied to the device 28 through an inverter 29.

When both of the adjusting dials 6, 8 are pushed to be made operative and the switches 20, 21 are closed, the signals SB and SF become high level H. One of the inputs of the AND circuit 24 is connected to the high level signal SB but the other input thereof is connected to the low level signal which is inverted from the high level signal SF via an inverter 30, so that the mode input $M_4$ of the multiplexer 31 is coupled to the low level output of the AND circuit 24. Thus, the multiplexer 31, which has received a manual digital signal MDF for fabric feed transformed from a voltage VF of the fabric feed amount adjusting dial 8 by a A/D converter 32, supplies the same to the multiplexor 19. The mode input $M_2$ of the multiplexor 19 is connected to the high level output of the OR circuit 25 and thereby produces the manual digital signal MDF. On the other hand, the mode input $M_1$ of the multiplexor 18 is connected to the high level signal SB and produces a manual digital signal MDB for needle amplitude which has been transformed by the A/D converter 32 from a voltage VB of the needle amplitude adjusting dial 6. These manual signals MDF and MDB are thus proceeded to the reduction restriction circuit 26, but since the mode input $M_3$ of the circuit 26 is connected to the low level output of the AND circuit 24, the circuit 26 is made inoperative, through which the manual signals MDF and MDB are passed to the calculator 16. In summary, when the signals SB and SF are both at the high level, the automatic similarity control of the invention is not effected, because the stitch control data PDB, PDF of the memory 12 for the needle amplitude and the fabric feed amount are each independently modified by the manual signals MDB, MDF respectively.

Figure 1A:
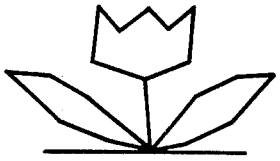
FIGS. 1*a* and 1*b* show a type of stitch pattern which may be produced by the invention in which the pattern A is produced by auto-data and the pattern B is proportionally reduced in size thereof by application of the invention.
Figure 1B:
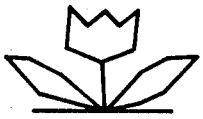

The automatic similarity control operation of the invention is effected when the switch 20 is closed whereas the switch 21 is opened, that is when the needle amplitude adjusting dial 6 is pushed but the fabric feed adjusting dial 8 is not pushed. In this case, the inputs of the AND circuit 24 are connected to the high level signal SB and the low level signal SF via the inverter 30 and to the high level similarity signal SS, so that the high level output of the AND ciricuit 24 is supplied to the mode input $M_4$ of the multiplexer 31. Thus, the same and single manual digital signal MDB for the needle amplitude is transmitted into the multiplexors 18 and 19 as shown in FIG. 3, the former having the mode input $M_1$ connected to the high level signal SB being adapted to produce the signal MDB and the latter also having the mode input $M_2$ connected to the high level output of the OR circuit 25. Thus, the signals MDB enter the reduction restriction circuit 26 through the multiplexors 18, 19 respectively. On the other hand, the circuit 26 has the mode input $M_3$ coupled to the high level output of the AND circuit 24, so that the signals MDB may be subjected to the reduction restriction execution by the circuit 26. After that, these manual signals MDB are transmitted to the calculator 16 whereat the predetermined data PDB, PDF for the needle amplitude and the fabric feed are modified per stitch by the common digital value of the manual signal MDB. Consequently, the selected stitch pattern will have the stitches each proportionally enlarged or reduced, and therefore the size of the pattern will be accordingly enlarged or reduced without deforming the configulation thereof. The ratio of enlargement or reduction can be manually determined by rotating the dial 6 to coincide with a corresponding mark (not shown in FIG. 1).

Figure 4:
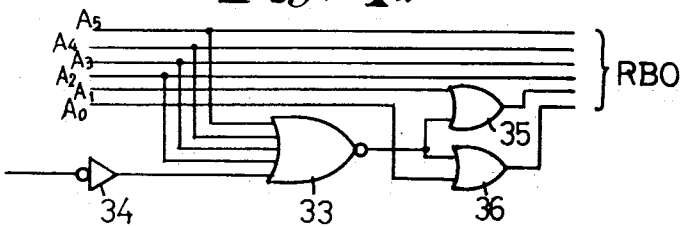
FIG. 4 is a diagram of a reduction restriction circuit, a part of the control circuit shown in FIG. 3.

FIG. 4 shows a diagram of the reduction restriction circuit 26 in which a plurality of the inputs $A_0$–$A_5$ supplied from the multiplexor 18 and the corresponding output RBO are shown. The other set of inputs $B_0$–$B_5$ and their output RFO of the circuit 26 are omitted to show from this figure for convenience sake. The reduction restriction circuit 26 is actuated only when the mode input $M_3$ is connected to the high level output of the AND circuit 24, that is when the signal SB is at the high level whereas the signal SF is at the low level. The high level input $M_3$ of the circuit 26 is inverted to the low level via an inverter 34, and is connected to one of the inputs of the NOR circuit 33. When the operator selects a very large number of the reduction rate by means of the dial 6 so that, for example, the manual signal MDB comprises the low level signals $A_0$–$A_5$, the NOR circuit 33 receives low level signals at all of the inputs thereof and therefore produces the high level output, which is connected to an input of the OR circuit 35 and also to an input of the OR circuit 36. Then, the outputs of these OR circuits 35, 36 become high levels so that the manual data value should be maintained at least 3, for example, even when a greater value of reduction rate is selected by the operator. This reduction restriction circuit 26 will function to prevent the needle 7 from repeatedly penetrating the same point of the fabric, and thereby to prevent the thread-cut of the pattern stitches.

Meanwhile, when only the switch 21 is closed by pushing the fabric feed adjusting dial 8, the output of the AND circuit 24 will be at a low level whereas the output of the OR circuit 25 becomes high level. In this case, the manual feed signal MDF is delivered, via the multiplexors 31 and 19 and via the reduction restriction circuit 26 in its inoperative position, to the calculator 16 whereby the fabric feed control data PDF is modified.

While the invention has been described in conjunction with a specific embodiment thereof, it is to be understood that many different modifications and variations may be made without departing from the spirit and scope thereof.

What is claimed is:

1. An electronic sewing machine comprising, in combination, a first electronic memory storing stitch control data for a plurality of stitch patterns which are selectively read out for controlling needle lateral amplitude and fabric feeding amount per stitch of a selected pattern;

a second electronic memory storing auto-data which are each specific to each of the patterns stored in said first memory for automatically acting on each data of the selected pattern, thereby determining the optimum size of the pattern;

first means for detecting if the selected pattern is proportionally variable, which in the affirmative produces an address signal for reading out the initial stitch control data of the selected pattern from said first memory and another address signal for reading out an auto-data specific to the selected pattern from said second memory;

second means manually operated to produce first and second signals for modifying the stitch control data for the needle lateral amplitude and fabric feeding amount respectively, said second means including first and second switches being selectively operated to make effective said first and second signals and said auto-data;

third means operated in association with a first state of said first and second switches to make effective said auto-data read out from said second memory, said third means operated in association with a second state of said first and second switches to make effective one of said first and second signals;

calculating means receiving said stitch control data of said selected pattern from said first memory, said calculating means receiving said auto-data from said third means when said first and second switches are in said first state and calculating said stitch control data with said auto-data to produce a first set of modified data for producing a standard size of a selected pattern, said calculating means receiving said one of said first and second signals when said first and second switches are in said second state and calculating said stitch control data with said one signal to produce a second set of modified data for producing a proportionally reduced size of said selected pattern; and drive means operated in response to said modified stitch control data supplied from said calculating means to control the needle lateral amplitude and the fabric feeding amount.

2. The electronic sewing machine as defined in claim 1 wherein said means associated with said first and second switches is operated in association with a third state of said first and second switches to make effective the other of said first and second signals, and said calculating means receives said stitch control data and said other signal and calculates said stitch control data with said other signal to produce a third set of modified data for producing another reduced pattern.

3. The electronic sewing machine as defined in claim 1 wherein said means associated with said first and second switches is operated in association with a fourth state of said first and second switches to make effective both of said first and second signals, and said calculating means receives said stitch control data and said both signals and calculates said stitch control data with said both signals to produce a fourth set of modified data for producing still another reduced pattern.

* * * * *